US006987487B2

(12) United States Patent
Zimmerman et al.

(10) Patent No.: US 6,987,487 B2
(45) Date of Patent: Jan. 17, 2006

(54) ANTENNA SYSTEM

(75) Inventors: Martin L. Zimmerman, Chicago, IL (US); Jamie Paske, Darien, IL (US); James Giacobazzi, Bloomingdale, IL (US); Kevin E. Linehan, Justice, IL (US)

(73) Assignee: Andrew Corporation, Orland Park, IL (US)

( * ) Notice: Subject to any disclaimer, the term of this patent is extended or adjusted under 35 U.S.C. 154(b) by 231 days.

(21) Appl. No.: 10/147,534

(22) Filed: May 17, 2002

(65) Prior Publication Data

US 2002/0135524 A1 Sep. 26, 2002

Related U.S. Application Data

(63) Continuation of application No. 09/788,790, filed on Feb. 19, 2001, now Pat. No. 6,573,875.

(51) Int. Cl.
*H01Q 3/00* (2006.01)

(52) U.S. Cl. ..... 343/757; 343/766; 343/853

(58) Field of Classification Search ..... 343/757, 343/758, 765, 766, 850, 853; 342/368
See application file for complete search history.

(56) References Cited

U.S. PATENT DOCUMENTS

| | | | |
|---|---|---|---|
| 2,041,600 A | 5/1936 | Friis | 342/361 |
| 2,432,134 A | 12/1947 | Bagnall | 342/374 |
| 2,540,696 A | 2/1951 | Smith, Jr. | 343/766 |
| 2,596,966 A | 5/1952 | Lindsay, Jr. | 343/816 |
| 2,648,000 A | 8/1953 | White | 343/791 |
| 2,773,254 A | 12/1956 | Engelmann | 342/365 |
| 2,836,814 A | 5/1958 | Nail | 342/368 |
| 2,968,808 A | 1/1961 | Russell | 342/375 |

(Continued)

FOREIGN PATENT DOCUMENTS

| | | |
|---|---|---|
| AU | B-38746/93 | 7/1993 |
| AU | B-41625/93 | 1/1994 |
| AU | B-80057/94 | 4/1995 |
| DE | 3322-986 A | 6/1983 |
| DE | 3323-234 A | 6/1983 |
| DE | 3323 234 A1 | 10/1985 |
| EP | 137-562 A | 10/1983 |
| EP | 0 137 562 A2 | 4/1985 |
| EP | 241-153 A | 7/1986 |
| EP | 0 241 153 B1 | 10/1987 |
| EP | 357-165 A | 8/1988 |
| EP | 398-637 A | 5/1989 |
| EP | 0 357 165 A2 | 3/1990 |
| EP | 0 398 637 A2 | 11/1990 |
| EP | 0 423 512 A2 | 4/1991 |
| EP | 0 540 387 A2 | 5/1993 |

(Continued)

OTHER PUBLICATIONS

Patent Abstracts of Japan Publication No. 06–326501.
Microstrip Base Station Antennas for Cellular Communications, Strickland et al., 1991 IEEE.

(Continued)

*Primary Examiner*—Hoang V. Nguyen
(74) *Attorney, Agent, or Firm*—Welsh & Katz, Ltd.

(57) ABSTRACT

An antenna assembly for emitting a signal. The antenna assembly includes at least two antennas which are separated into a first group and a second group. Both groups of antennas are mounted on a panel. A first phase adjuster is coupled to the fist antenna group. The first phase adjuster is also coupled to a second phase adjuster, which is also coupled to said second antenna group. The first phase adjuster is coupled to the second phase adjuster, such that an adjustment of the first phase adjuster causes an adjustment of the second phase adjuster. The first phase adjuster is adapted to adjust a phase angle of the signal of the first antenna group, while the second phase adjuster is adapted to adjust a phase angle of the signal of said second antenna group.

33 Claims, 8 Drawing Sheets

U.S. PATENT DOCUMENTS

| | | | | |
|---|---|---|---|---|
| 3,032,759 | A | 5/1962 | Ashby | 342/154 |
| 3,032,763 | A | 5/1962 | Sletten | 343/824 |
| 3,277,481 | A | 10/1966 | Robin et al. | 342/373 |
| 3,969,729 | A | 7/1976 | Nemit | 343/756 |
| 4,129,872 | A | 12/1978 | Toman | 343/768 |
| 4,176,354 | A | 11/1979 | Hsiao et al. | 343/17.7 |
| 4,241,352 | A | 12/1980 | Alspaugh et al. | 343/700 MS |
| 4,249,181 | A | 2/1981 | Lee | 343/100 CS |
| 4,427,984 | A | 1/1984 | Anderson | 343/764 |
| 4,451,699 | A | 5/1984 | Gruenberg | 455/17 |
| 4,532,518 | A | 7/1985 | Gaglione et al. | 343/372 |
| 4,564,824 | A | 1/1986 | Boyd, Jr. | 333/137 |
| 4,575,697 | A | 3/1986 | Rao et al. | 333/157 |
| 4,652,887 | A | 3/1987 | Cresswell | 343/766 |
| 4,714,930 | A | 12/1987 | Winter et al. | 343/786 |
| 4,717,918 | A | 1/1988 | Finken | 342/368 |
| 4,768,001 | A | 8/1988 | Chan-Son-Lint et al. | 333/159 |
| 4,779,097 | A | 10/1988 | Morchin | 343/757 |
| 4,788,515 | A | 11/1988 | Wong et al. | 333/160 |
| 4,791,428 | A | 12/1988 | Anderson | 343/758 |
| 4,804,899 | A | 2/1989 | Wurdack et al. | 318/600 |
| 4,814,774 | A | 3/1989 | Herczfeld | 342/372 |
| 4,821,596 | A | 4/1989 | Eklund | 74/479 |
| 4,881,082 | A | 11/1989 | Graziano | 342/432 |
| 5,162,803 | A | 11/1992 | Chen | 342/372 |
| 5,175,556 | A | 12/1992 | Berkowitz | 342/354 |
| 5,181,042 | A | 1/1993 | Kaise et al. | 343/700 MS |
| 5,184,140 | A | 2/1993 | Hariu et al. | 342/372 |
| 5,214,364 | A | 5/1993 | Perdue et al. | 318/600 |
| 5,281,974 | A | 1/1994 | Kuramoto et al. | 343/700 MS |
| 5,440,318 | A | 8/1995 | Butland et al. | 343/814 |
| 5,488,737 | A | 1/1996 | Harbin et al. | 455/33.1 |
| 5,512,914 | A | 4/1996 | Hadzoglou et al. | 343/816 |
| 5,551,060 | A | 8/1996 | Fujii et al. | 455/33.4 |
| 5,596,329 | A | 1/1997 | Searle et al. | 342/374 |
| 5,617,103 | A | 4/1997 | Koscica et al. | 343/700 MS |
| 5,659,886 | A | 8/1997 | Taira et al. | 455/81 |
| 5,798,675 | A | 8/1998 | Drach | 333/161 |
| 5,801,600 | A | 9/1998 | Butland et al. | 333/127 |
| 5,805,996 | A | 9/1998 | Salmela | 455/453 |
| 5,818,385 | A | 10/1998 | Bartholomew | 342/372 |
| 5,832,365 | A | 11/1998 | Chen et al. | 455/15 |
| 5,905,462 | A | 5/1999 | Hampel et al. | 342/372 |
| 5,917,455 | A | 6/1999 | Hyunh et al. | 343/792.5 |
| 5,983,071 | A | 11/1999 | Gagnon et al. | 455/3.2 |
| 5,995,062 | A | 11/1999 | Denney et al. | 343/853 |
| 6,078,824 | A | 6/2000 | Sogo | 455/562 |
| 6,128,471 | A | 10/2000 | Quelch et al. | 455/25 |
| 6,188,373 | B1 | 2/2001 | Markek | 343/893 |
| 6,198,458 | B1 | 3/2001 | Heinz et al. | 343/853 |
| 6,208,222 | B1 | 3/2001 | Sinsky | 333/161 |
| 6,239,744 | B1 | 5/2001 | Singer et al. | 342/359 |
| 6,310,585 | B1 | 10/2001 | Marino | 342/818 |
| 6,445,353 | B1 | 9/2002 | Weinbrenner | 343/763 |
| 2003/0109231 | A1 | 6/2003 | Marcus et al. | 455/90 |

FOREIGN PATENT DOCUMENTS

| | | | |
|---|---|---|---|
| EP | 0 605 182 | A2 | 12/1993 |
| EP | 0 588 179 | A1 | 3/1994 |
| EP | 0 593 822 | A1 | 4/1994 |
| EP | 0 595 726 | A1 | 5/1994 |
| EP | 0 618 639 | A2 | 10/1994 |
| EP | 0 616 741 | B1 | 11/1995 |
| EP | 1 067 626 | A2 | 1/2001 |
| FR | 2 581 255 | | 10/1986 |
| GB | 1 314 693 | | 4/1973 |
| GB | 2 035 700 | A | 6/1980 |
| GB | 2 158 996 | A | 11/1985 |
| GB | 2 159 333 | A | 11/1985 |
| GB | 2 165 397 | A | 4/1986 |
| GB | 2 196 484 | A | 4/1988 |
| GB | 2 205 946 | A | 12/1988 |
| GB | 2 232 536 | A | 12/1990 |
| JP | 61-172411 | | 8/1986 |
| JP | 1-120906 | | 5/1989 |
| JP | 2-121504 | | 5/1990 |
| JP | 02-174302 | A | 5/1990 |
| JP | 02-174403 | A | 5/1990 |
| JP | 2-174402 | | 7/1990 |
| JP | 2-290306 | | 11/1990 |
| JP | 4-286407 | | 10/1992 |
| JP | 05-37222 | | 2/1993 |
| JP | 5-121915 | | 5/1993 |
| JP | HEI-5-121915 | | 5/1993 |
| JP | 5-191129 | | 7/1993 |
| JP | 6-196927 | | 7/1994 |
| JP | 08047043 | A | 2/1996 |
| JP | 11-355038 | | 12/1999 |
| JP | 2001-111473 | | 4/2001 |
| NZ | 264864 | | 11/1994 |
| NZ | WO 95/10862 | | 4/1995 |
| NZ | 272778 | | 8/1995 |
| WO | WO 88/08621 | | 11/1988 |
| WO | WO 92/16061 | | 9/1992 |
| WO | WO 93/12587 | | 6/1993 |
| WO | WO 96/14670 | | 5/1996 |

OTHER PUBLICATIONS

Antennas, NIG Technical Reports vol. 57, Mar. 8–10, 1977 (including original in German and complete translation into English).

Product Sheet for "900 MHz Base Station Antennas for Mobile Communication," Kathrein, 2 pages (no date).

PCT International Search Report for International Application No. PCT/US02/01993.

Variable–Elevation Beam–Aerial Systems for 1 ½ Metres, *Journal IEE Part IIIA*, vol. 93, 1946, Bacon, G.E.

Radar Antennas, *Bell Systems Technical Journal*, vol. 26, Apr. 1947, pp. 219 to 317, Friis, H.T. and Lewis, W.D.

*The Sydney University Cross–Type Radio Telescope*, Proceedings of the IRE Australia, Feb., 1963, pp. 156 to 165, Mills, B.Y., et al.

"Microwave Scanning Systems" published about 1985, pp. 48 to 131.

"Low Sidelobe and Titled Beam Base–Station Antennas for Smaller–Cell Systems," published in or about 1989, Yamada & Kijima, NTT Radio Communication Systems Laboratories, pp. 138 to 141.

"Electrical Downtilt Through Beam–Steering versus Mechanical Downtilt," G. Wilson, published May 18, 1992, pp. 1–4.

*Mobile Telephone Panel Array (MTPA) Antenna: Field Adjustable Downtilt Models* published in Australia on or about May 4, 1994.

*Mobile Telephone Panel Array (MTPA) Antenna: VARITILT Continuously Variable Electrical Downtilt Models* (including specifications sheet) published in Australia on or about Sep. 1994.

Supplementary European Search Report for Application No. EP 95 93 3674 dated Jan. 9, 1999.

International Search Report for PCT/NZ 95/00106 mailed Jan. 23, 1996.

European Search Report for Application No. EP 02 01 0597.

Beam Steering of Planar Phased Arrays—T.C. Cheston, John Hopkins University, Applied Physics Laboratory (Chapter in Phased Array Antennas, Oliner & Knittel 1972).

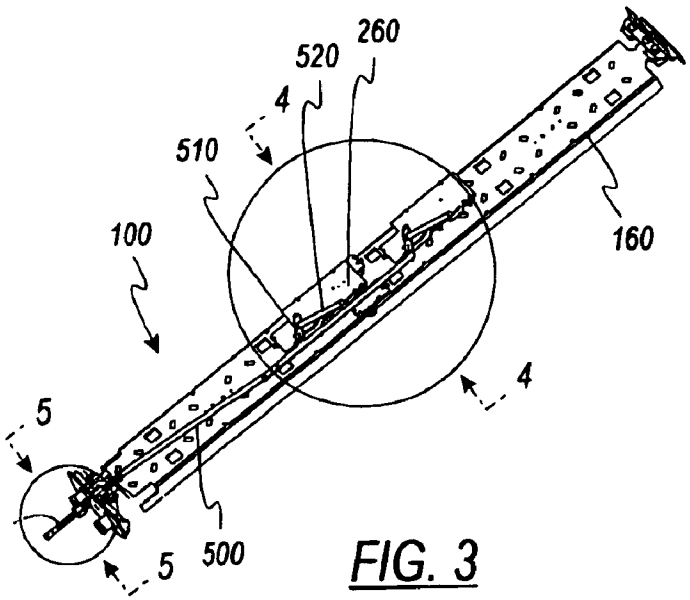
FIG. 3
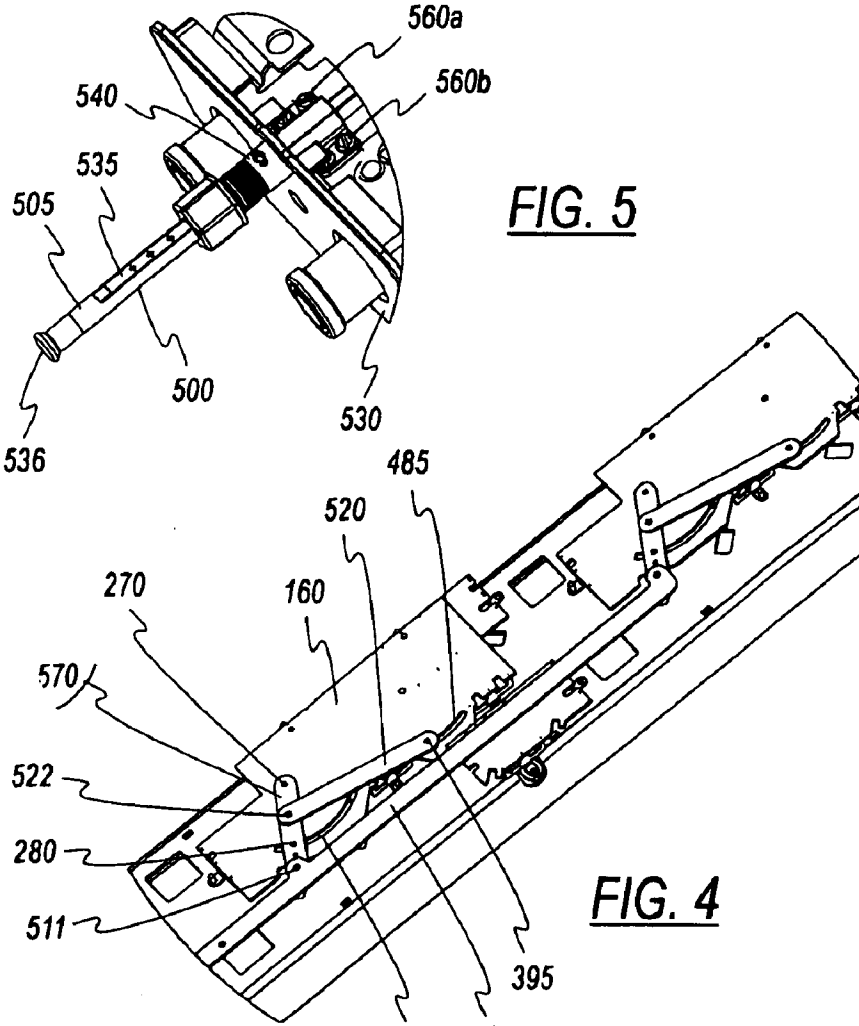
FIG. 5
FIG. 4

ANTENNA SYSTEM

This is a continuation of application Ser. No. 09/788,790, filed Feb. 19, 2001, entitled Antenna System, and currently pending. Now U.S. Pat. No. 6,573,875.

BACKGROUND OF THE INVENTION

In many passive antenna assemblies, it is often desired to be able to adjust a radiation pattern of the antenna assembly after the antenna assembly has been installed on a tower. The need may arise due to a number of factors, including new construction, which may create obstacles, vegetation growth, or other changes in the surrounding environment. It may also be desired to alter the radiation pattern due to performance studies or to alter the shape of the area the antenna covers.

There are various ways that the radiation pattern may be altered. One method is to physically change the location of the antenna assembly. Once the assembly has been installed on a tower, however, this becomes difficult. It is also possible to change the azimuth and elevation of the individual antennas, but such a method is expensive when applied to several antennas. Also, the mechanical device required to adjust the azimuth and elevation may interfere with the mechanical antenna mount.

Another method that has been utilized to adjust the radiation pattern of a number of antennas grouped onto one antenna assembly is to alter the phase angle of the individual antennas. By altering the phase angle of the individual antennas, a main beam (which causes the radiation pattern) is tilted relative to the surface of the earth. The antennas are grouped into a first group, a second group, and a third group. All three groups are disposed along a panel of the antenna assembly. A phase adjuster is disposed between two of the antenna groups, such that an adjustment of the phase adjuster changes the radiation pattern. The phase adjuster comprises a conductor coupled with a transmission line to create a capacitor. The conductor is rotatable and moves along the transmission line, changing the location of the capacitor on the transmission line. The transmission line is coupled to an antenna which has a phase angle. The phase angle is dependant partially on the location of the capacitor. Thus, by changing the location of the capacitor, the phase angle is changed. The phase adjuster may be coupled to a plurality of antennas and acts to adjust the phase angle of all of them.

The phase adjusters currently in use, however, have numerous drawbacks. First, the conductor is often made of brass which is expensive to etch and cut. Therefore, the conductor is usually cut in a rectangular shape. The path of the transmission line, however, is arcuate. The conductor does not cover the entire width at the capacitor, which decreases the effectiveness of the capacitance.

Another problem with current phase adjusters is the coupling of a power divider to the phase adjuster. The antenna assembly receives power from one source. Each of the three groups of antennas, however, has different power requirements. Thus, power dividers must be connected to the assembly. Currently, a power divider may be a series of cables having different impedances. Using a variety of cables makes manufacturing difficult since the cables have to be soldered together. Also, since manual work is required, the chances of an error occurring is increased. Another method of dividing the power is to create a power divider on a PC board and then cable the power divider to the phase adjuster. Although this decreases some costs, it still requires the extensive use of cabling, which is a disadvantage.

A third problem is caused by the use of cable lines having different lengths to connect an antenna to the appropriate output from the phase adjuster. Each antenna has a different default phase angle when the phase adjuster is set to zero. The default phase angle is a function of the cable length coupled with the length of the transmission line. To achieve the differing default phase angles, cables of varying lengths are attached to different antennas. Although this only creates a slight increase in manufacturing costs since cables of varying lengths must be purchased, it greatly increases the likelihood of error during installation. In numerous antenna assemblies, the cable lengths only differ by an inch or less. During assembly, if a cable is not properly marked, it may be difficult for the person doing the assembly to tell the difference between the different sizes of cable.

To move the phase adjuster, an actuator is located on a side of the panel and may include a small knob or rotatable disc for manually changing the phase adjuster. Thus, whenever the radiation pattern needs to be adjusted, a person must climb the tower and up the side of the panel to the phase adjuster. This is a difficult and time consuming process. Also, it is only possible to move the actuator manually, requiring the exertion of physical labor. In addition, it is a dangerous activity since the antennas are located on a tower and it is possible for a person to fall or otherwise become injured in the climbing process.

BRIEF DESCRIPTION OF THE DRAWINGS

The foregoing and other advantages of the invention will become apparent upon reading the following detailed description and upon reference to the drawings.

FIG. 3 is perspective side view of a panel and the phase adjuster assembly according to one embodiment of the present invention.

FIG. 4 is an enlarged view of section B shown in FIG. 3.

FIG. 5 is an enlarged view of section A shown in FIG. 3.

Figure 1:
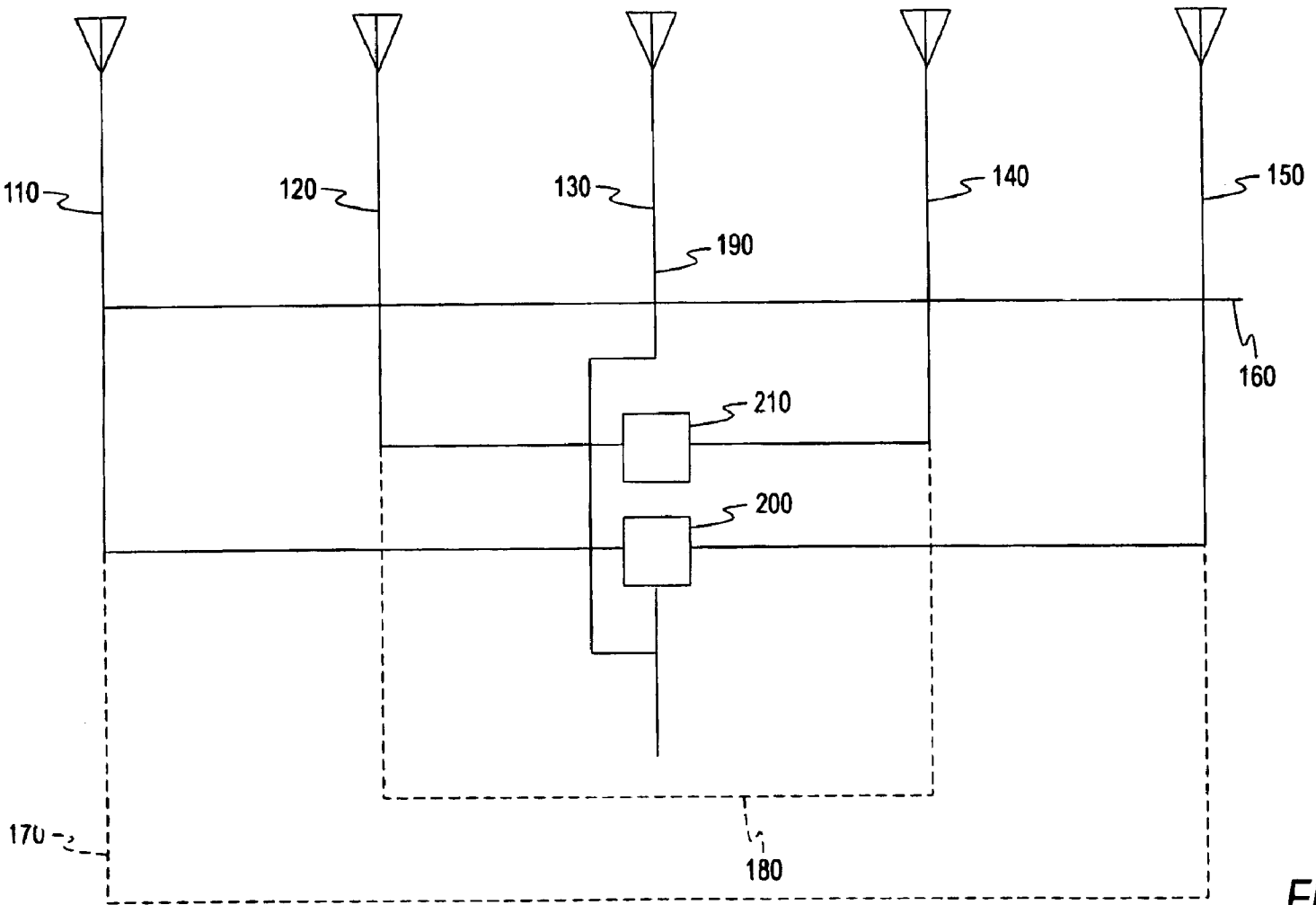
FIG. 1 is a schematic of an antenna assembly of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 is a side view of an antenna assembly 100 of the present invention. The antenna assembly 100 is comprised of a plurality of antennas 110, 120, 130, 140, 150 disposed along a panel 160. The antennas 110, 120, 130, 140, 150 are grouped into a first group 170, a second group 180, and a third group 190. The first antenna 110 and the fifth antenna 150 are in the first group 170. The second antenna 120 and the fourth antenna 140 are in the second group 180 and the third antenna 130 is in the third group 190.

To adjust the radiation pattern, the vertical electromagnetic beam of the antenna assembly 100 must be adjusted. This is accomplished by adjusting the phase angle of the first group 170 relative to the second group 180. The first group 170, however, must be adjusted by an amount different than the amount of the second group 180. To accomplish this, a first phase adjuster 200 is attached to the first group 170, and a second phase adjuster 210 is attached to the second group 180. The adjustment amount of the second group 180 is often a function of the amount of adjustment of the first group 170. To ensure that the first and second groups 170, 180 are adjusted in the correct ratio, the second adjuster 210 may be connected to the first adjuster 200, such that an adjustment of the first adjuster causes an adjustment of the second adjuster. More particularly, the second phase adjuster 210 may be connected to the first phase adjuster 200, such that an adjustment of the first phase adjuster 200 for a predetermined distance causes the second phase adjuster 210 to move proportional to the distance.

Figure 2:
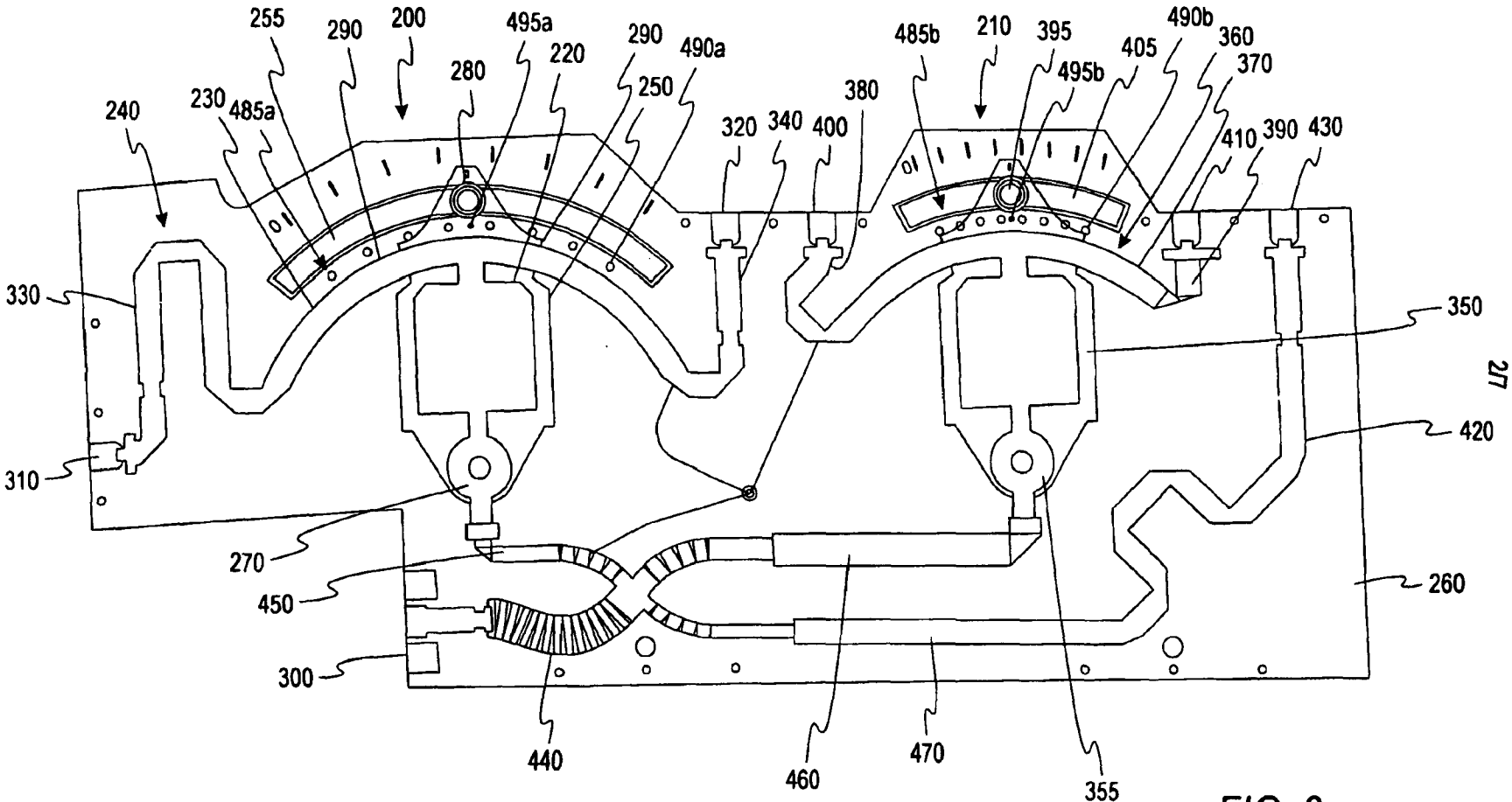
FIG. 2 is a schematic view of a phase adjuster assembly according to one embodiment of the present invention.

FIG. 2 depicts a schematic view of a first and second phase adjusters 200, 210 respectively, adapted to adjust the vertical beam or vertical beam downtilt angle. The first phase adjuster 200 is coupled to the first antenna group 170, and the second phase adjuster 210 is coupled to the second antenna group 180. Each of the plurality of antennas 110, 120, 130, 140, 150 has a different phase angle. By adjusting the phase angles of the plurality of antennas 110, 120, 130, 140, 150, or at least of the first and second groups 170, 180 of antennas, the vertical beam of the antenna assembly 100 is adjusted.

The first and second phase adjusters 200, 210 operate in the same fashion. For simplicity, the description will be described in more detail regarding the first phase adjuster 200. To adjust the phase angle, a conductive wiper 220 slides over a first arcuate portion 230 of a first transmission line 240. One end of the first transmission line 240 is coupled to the first antenna 110, while the other end of the first transmission line 240 is coupled to the fifth antenna 150. The conductive wiper 220 in connection with the first arcuate portion 230 acts as a capacitor. To the antennas 110, 150, the capacitor is seen as a short circuit at high frequencies. The length of the first transmission line 240 up to the point of the short circuit affects the phase angle of the antenna. As the conductive wiper 220 slides over the first arcuate portion 230, the location of the short circuit changes, changing the length of the first transmission line 240 and, thus, the phase angle of the two antennas 110, 150. Since the antennas 110, 150 are located at opposite ends of the first transmission line 240, the movement of the short circuit lengthens one transmission line as seen by one antenna while shortening the transmission line as seen by the other antenna. In other words, the transmission line has a finite length. The finite length of the transmission line is divided into a first effective length and a second effective length. The first effective length is from the first antenna 110 to the location of the wiper 220 on the transmission line 240. The second effective length is measured from the fifth antenna 150 to the location of the wiper 220 on the transmission line 240. As the wiper 220 is adjusted towards the fifth antenna 150, the first effective length is lengthened while the second effective length is shortened. As the wiper 220 is adjusted towards the first antenna 110, the first effective length is shortened while the second effective length is lengthened.

In this particular embodiment, the conductive wiper 220 is a first rotatable PC board 250 with a metallic side. The first transmission line 240 is mounted on a separate fixed PC board 260. The fixed PC board 260 and first rotatable PC board 250 act as a dielectric between the capacitor. In prior art systems, an air dielectric was sometimes used. If the conductive wiper changes its spacing relative to the first arcuate portion 230, however, the capacitor's capacitance is altered, thus, changing the impedance match of the phase shifter. If the two sections touch, the capacitance is destroyed, which adversely affects the performance of the antenna even more. Other systems use a sheet dielectric to separate the conductive wiper from the transmission line which have to be mounted using standoffs and point fasteners. The sheet, however, tends to attenuate the capacitive effect. By using the PC boards as the dielectric, the conductive wiper cannot touch the transmission line nor are the capacitive effects attenuated. Also, the manufacturing costs for making the PC board are much lower than having to mount the sheet dielectric.

The first rotatable PC board 250 is pivotally connected to the fixed PC board 260 at a joint 270, which acts as the pivot point for the first rotatable PC board 250. At another end, a joint 280, the first rotatable PC board 250 is slidably mounted in a first slot 255. A mechanical actuator (to be described) including an actuator rod 500 and a main arm 500*a* moves the first rotatable PC board 250 in an arcuate path over the first arcuate portion 230, thus changing the phase angle of the antennas 110, 150 as discussed above.

To increase the capacitive effects, an end 290 of the first rotatable PC board 250 that glides over the first arcuate portion 230 may be curved. The radius of curvature of the end 290 of the first rotatable PC board 250 is the same as the radius of curvature of the first arcuate portion 230. Also, both the first rotatable PC board 250 and the first arcuate portion 230 have the same center point located at the joint 270. By completely aligning with the arcuate portion 230, the capacitance is increased, increasing the effectiveness of the first phase adjuster 200.

The first transmission line 240 is electrically connected to an input 300 for receiving power. The first rotatable PC board 250 is also electrically connected to the input 300. The first transmission line 240 is coupled to the first antenna 110 (shown in FIG. 1) at a first output 310, and also to the fifth antenna 150 (shown in FIG. 1) at a fifth output 320. Each of the antennas 110, 150 has a default phase angle when the capacitor is set to zero, which is marked on FIG. 2. The default phase angle of antenna 110 is a function of the length of the first transmission line 240 and a cable line (not shown) connecting the first transmission line 240 to the antenna 110. The first transmission line 240 includes a first path 330 leading from the first arcuate portion 230 to the first output 310. The length of the first path 330 is determined by the default phase angle of the first antenna 110. The first transmission line 240 also has a second path 340 connecting the first arcuate portion 230 to the fifth output 320. The length of the second path 340 is determined by the default angle of the fifth antenna 150. By varying the length of the first path 330 and the fifth path 340, the same length cables can be used during installation to connect the antennas to the output, which makes installation easier.

The second phase adjuster 210 acts in the same way as the first phase adjuster 200. A second rotatable PC board 350 is mounted on the fixed PC board 260 and is electrically coupled to the input 300. The second rotatable PC board 350 is rotatable around a joint 355, which is also where the second rotatable PC board 350 is connected to the fixed PC board 260. A second transmission line 360 having a second arcuate portion 370, a first path 380, and a second path 390 is also electrically connected to the input 300. The second rotatable PC board 350 glides over the second arcuate portion 370 to create the capacitor. The second rotatable PC board 350 is moved by mechanical actuator comprising actuator rod 500 and main arm 500*a*. Main arm 500*a* is connected through a linkage to be described to the board 350 at a joint 395 located in a second slot 405 in the fixed PC board 260. The first path 380 of the second transmission line 360 is connected to a second output 400, which is coupled to the second antenna 120 (FIG. 1), while the second path 390 of the second transmission line 360 is connected to a fourth output 410, which is coupled to the fourth antenna 140. As with the first phase adjuster 200, the lengths of the first and second paths 380, 390 are adjusted to create the proper default phase angle.

Also connected to the input 300 is a third transmission line 420, which is coupled to a third output 430, which is connected to the third antenna 130. The third transmission line 420 is of a length to create the proper default phase angle. Since all of the individual paths 330, 340, 380, 390, 420 of the various transmission lines 240, 360, 420 are adjusted to create the proper default phase angle, the same length cable can be used to connect the antennas 110, 120, 130, 140, 150 to their respective outputs 310, 400, 430, 410, 320. This not only makes manufacturing easier, it also eliminates the possibility of error during installation of connecting the wrong length cable to the output.

The input 300 is connected to a conductive strip 440 which acts as a power divider and bleeds off power to the first and second phase adjusters 200, 210 and the third transmission line 420. The conductive strip 440 has an established impedance. The impedance of the strip 440 is a function of the width of the strip 440. By changing the width of the conductive strip 440, the impedance and, thus, the power is changed. In the present invention, the conductive strip 440 branches into a first strip 450, a second strip 460, and a third strip 470. The first strip 450 transfers power from the conductive strip 440 to the first phase adjuster 200. The second strip 460 transfers power from the conductive strip 440 to the second phase adjuster 210, and the third strip 470 transfers power from the conductive strip 440 to the third transmission line 420. The width of each of the first, second, and third strips 450, 460, 470 is manufactured to draw the correct amount of power from the conductive strip (or power divider) 440. By using a power divider on the fixed PC board 260, excess cables are eliminated, which decreases cost and also increases the reliability of the antenna assembly 100. In another embodiment of the present invention, a conductive strip can be included to divide power on the first and second transmission lines 240, 360 along the arcuate portions 230, 370.

It is sometimes desirable to lock the first and second phase adjusters in a permanent position. In current systems, a phase adjuster was locked into position at the time of manufacture since the phase adjuster does not include markings or the like. In one embodiment of the present invention, however, the fixed PC board 260 includes a first set of markers 480*a* over the first slot 255 and a second set of markers 480*b* over the second slot 405. The sets of markers 485*a*, 485*b* provide a user with a method for viewing the phase angle settings of the first and second phase adjusters 200, 210. A locking mechanism 485 is included to lock the first and second phase adjusters 250, 350 in a set position. In one embodiment, a series of through holes 490*a*, 490*b* may also be included on the fixed PC board 260 and align with through holes 495*a*, 495*b* on the first and second rotatable PC boards 250, 350. A screw (not shown) may be used to lock the first or second first rotatable PC board 250, 350 to the fixed PC board 260. The use of markings and a lock system is a great improvement because the fixed PC board 260 can be assembled to the first and second phase adjusters 200, 210 without knowing if the phase angles need to be locked. Thus, this device may be manufactured prior to a purchase order being received. Once a purchase order is made, the markings and lock system can be used to lock the first and second phase adjusters 200, 210 in place, if so desired.

Turning now to FIGS. 2–4, FIG. 2 depicts a front side of the fixed PC board 260. FIG. 3 depicts a perspective view of a side of the panel 160 of the antenna assembly 100 and a back side of the fixed PC board 260. FIG. 4 is an enlarged detail of FIG. 3. In FIGS. 3 and 4, two similar PC boards 260, 261 are shown, each having a pair of first and second phase adjusters 200, 210. Both pairs operate in the same fashion, and are only illustrated to demonstrate that a plurality of PC boards 260, 261 may be mounted on a single panel, both being coupled to the same mechanical actuator (rod 500 and main arm 500*a*). As discussed above, the first phase adjuster 200 comprises the fixed PC board 260 with the first arcuate slot 255 cut through and the first rotatable PC board or wiper 250 (FIG. 2) on the other side of the fixed PC board 260. The second phase adjuster 210 comprises the fixed PC board 260, the second rotatable PC board or wiper 350 (FIG. 2), and the second arcuate slot 485. To cause the first and second rotatable PC boards 250, 350 to rotate, the main arm 500*a* is coupled to the rotatable PC boards 250, 350.

In one embodiment, the mechanical actuator comprises an actuator rod 500, main arm 500*a* and a linkage comprising a first arm 510, and a second arm 520. The main arm 500*a* is connected to one end of the first arm 510 at a pivot point 511. The other end of the first arm 510 is connected to the fixed PC board 260 and the first rotatable PC board 250 at the joint 270. A cross-section of this joint 270 would show there are three layers all connected, the first rotatable PC board 250, the fixed PC board 260, and the first arm 510. Since the fixed PC board 260 is stationary, the first arm 510 and the first rotatable PC board 250 also remain fixed at the joint 270. The joint 280 connects the first rotatable PC board 250 to the first arm 510 through the first slot 255 on the fixed PC board 260.

The second arm 520 is connected to the second rotatable PC board 350 through the second slot 405 at the joint 395. Thus, a movement of the second arm 520 causes the second rotatable PC board 350 to move along the second slot 405. The second arm 520 is also rotatably connected at a joint 522 to approximately midway between joint 270 and joint 280 on the first arm 510. Thus, as the first arm 510 is moved, the second arm 520 also moves. Since the second arm 520 is linked to the first arm 510 at the midpoint, as the joint 512 of the first arm 510 moves a predetermined distance, the joint 395 of the second arm 520 moves approximately half the predetermined distance. In other embodiments, the second arm 520 may be attached at different locations over the first arm 510, depending upon the desired ratio of movement between the first and second phase adjusters 200, 210.

FIG. 5 illustrates a grasping end 505 of the actuator rod 500 that extends out past a bottom 530 of the panel 160. The grasping end 505 of the actuator rod 500 is mounted on the bottom 530 of the panel 160. By extending the actuator rod 500 out through the bottom 530 of the panel 160, a person manually adjusting the mechanism only has to pull or push on the actuator rod 500, instead of having to rotate a small knob or disc located on the side of the panel 160, as done in the prior art. Also included on the grasping end 505 of the actuator rod 500 are markings 535 to indicate the amount of adjustment made by a person adjusting the mechanism, and a knob 536 is shown covering a threaded end 538 of the actuator rod 500. The markings 535 have a direct relationship to the vertical downtilt angle of the beam. For example, a zero marking on the rod correlates to a zero degree downtilt angle. Since the markings 535 are not detented, a user may adjust the downtilt angle as much or as little as needed. The downtilt angle need not be moved in degree or half degree increments. The knob 536 screws onto the threaded end 538 and enables the user to easily grasp the actuator rod 500 for movement purposes.

Figure 6A:
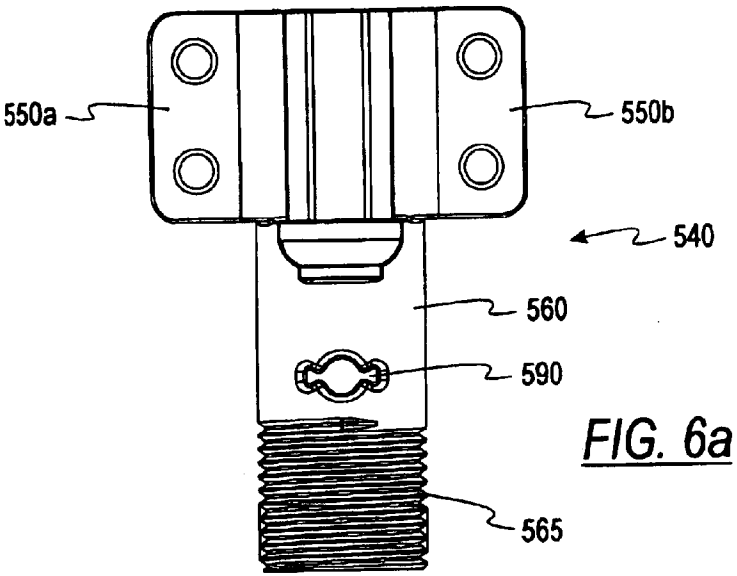
FIG. 6*a* is a front view of a bushing mount according to one embodiment of the present invention.
Figure 6B:
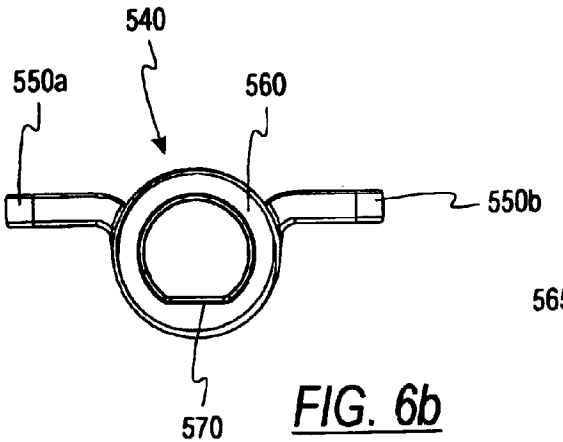
FIG. 6*b* is an end view of a bushing mount according to one embodiment of the present invention.
Figure 6C:
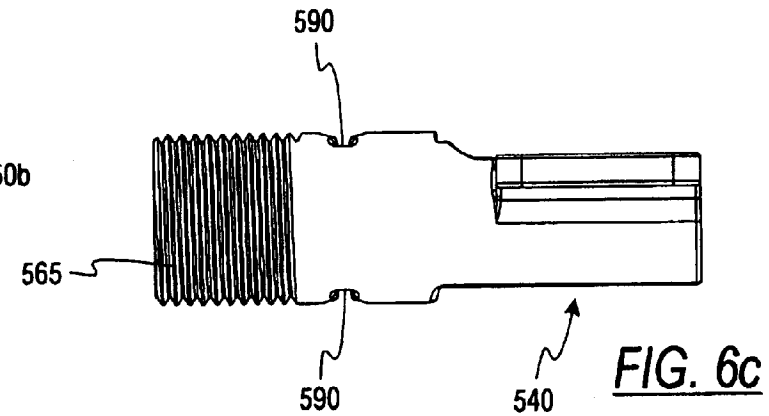
FIG. 6*c* is a side view of a bushing mount according to one embodiment of the present invention.

The actuator rod 500 is mounted onto the bottom 530 of the panel 160 by a bushing mount 540. The bushing mount 540 is best illustrated in FIGS. 6*a*–6*c*. The bushing mount 540 comprises a pair of brackets 550*a*, 550*b* which are attached to the panel 160. In the embodiment shown, the brackets 550*a*, 550*b* are attached via a pair of screws 560*a*, 560*b* (shown in FIG. 5). It is also contemplated, however, that other methods, such as rivets, adhesive heat staking, welding, and brazing, may be utilized.

The bushing mount 540 also has a cylindrical portion 560 adapted to receive the actuator rod 500. The cylindrical portion 560 of the bushing mount 540 allows the actuator rod 500 to be slid up and down, enabling movement. To prevent the actuator rod 500 from rotating within the cylindrical portion 560, however, a flat section 570 (FIG. 6*b*) is included on the inner wall of the cylindrical portion 560. One end of the cylindrical portion 560 includes a threaded portion 565 which will be described in more detail below.

As mentioned above, the grasping end 505 of the actuator rod 500 includes markings 535. The bushing mount 540 includes an indicator window 590 on opposite sides of the cylindrical portion 560 to enable a user to see the markings 535 (seen in FIG. 6*c*). Also, in one embodiment, the bushing mount 540 may be clear plastic so that all of the markings 535 are visible to the user.

Figure 7:
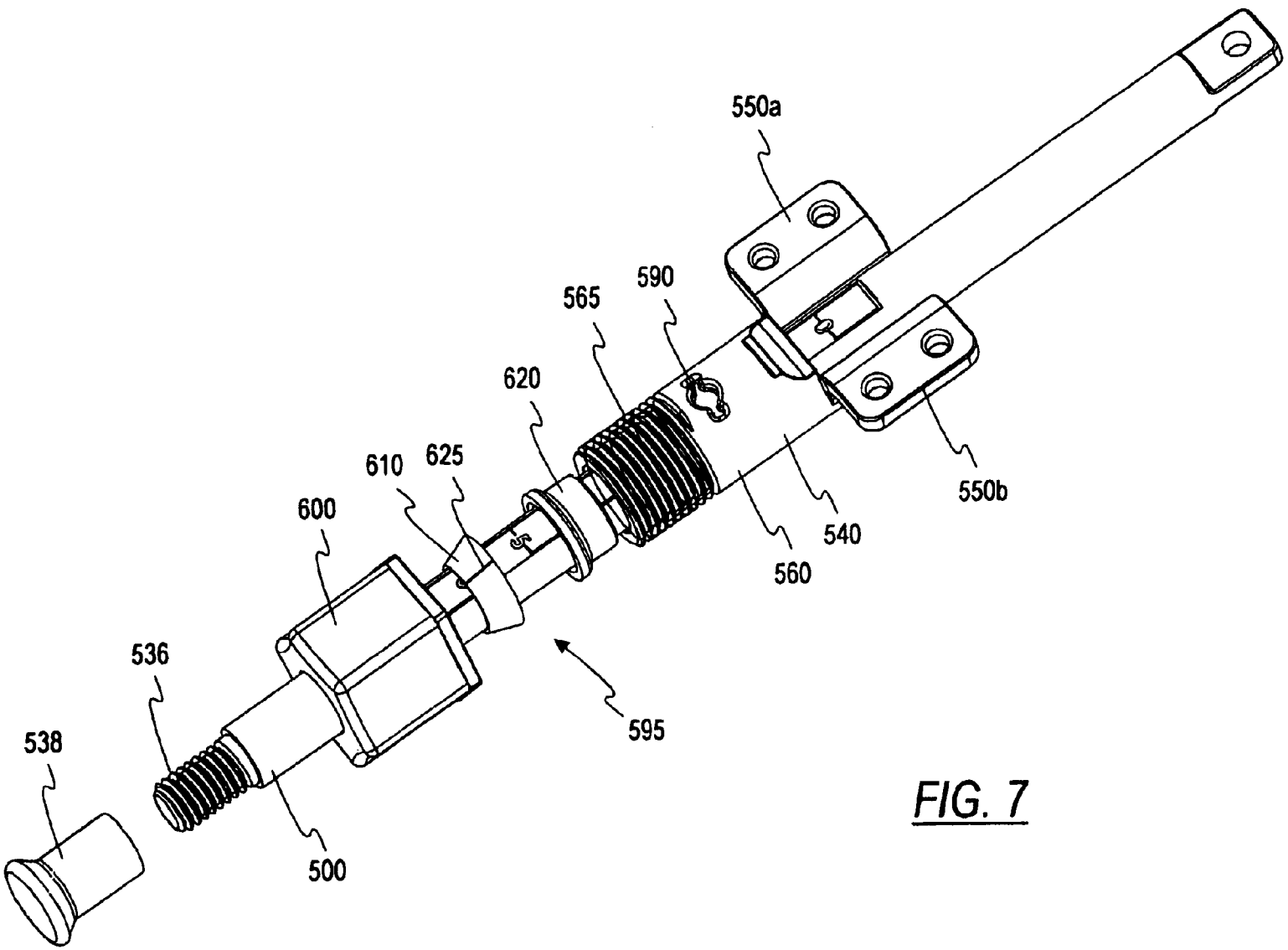
FIG. 7 is an exploded perspective view of an actuator rod according to one embodiment of the present invention.
Figure 8:
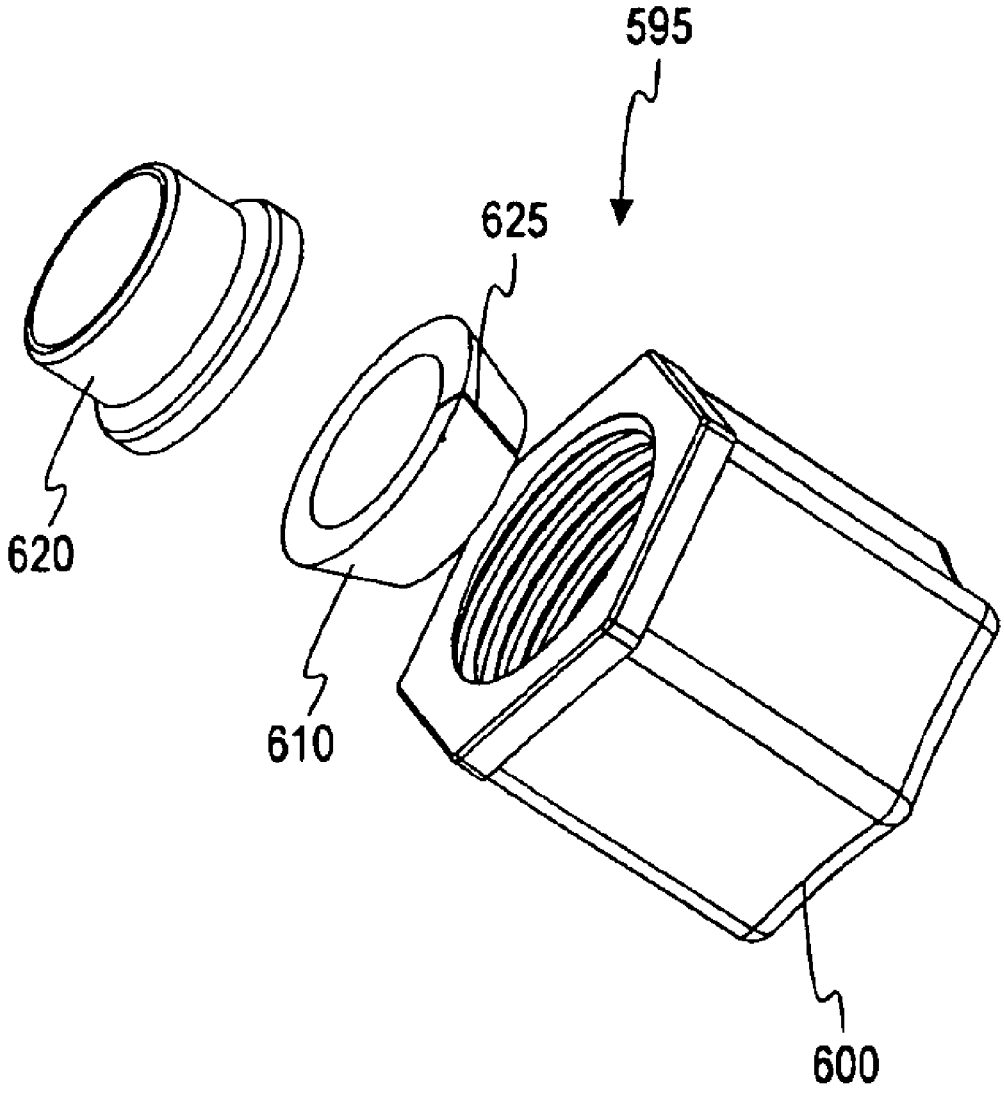
FIG. 8 is a perspective view of a compression nut according to one embodiment of the present invention.

As shown in FIGS. 7 and 8, a compression nut 595 is also slid over the actuator rod 500. The compression nut 595 includes three parts, a threaded nut 600, a plastic gripper 610, and a ferrule 620. The threaded nut 600 of the compression nut 595 screws over the threaded portion 565 of the bushing mount 540 and acts to lock the actuator rod 500 in place. When the threaded nut 600 is being screwed over the threaded portion 565 of the bushing mount 540, the plastic gripper 610 and the ferrule 620 are sandwiched against the bushing mount 540. The ferrule acts as a seal against the bushing mount 540. The plastic gripper 610 contains a slit 625, which decreases in width as the threaded nut 600 is tightened against the bushing mount 540. This causes the compression nut 595 to grip the bushing mount 540, and lock the actuator rod 500 in place.

Figure 8A:
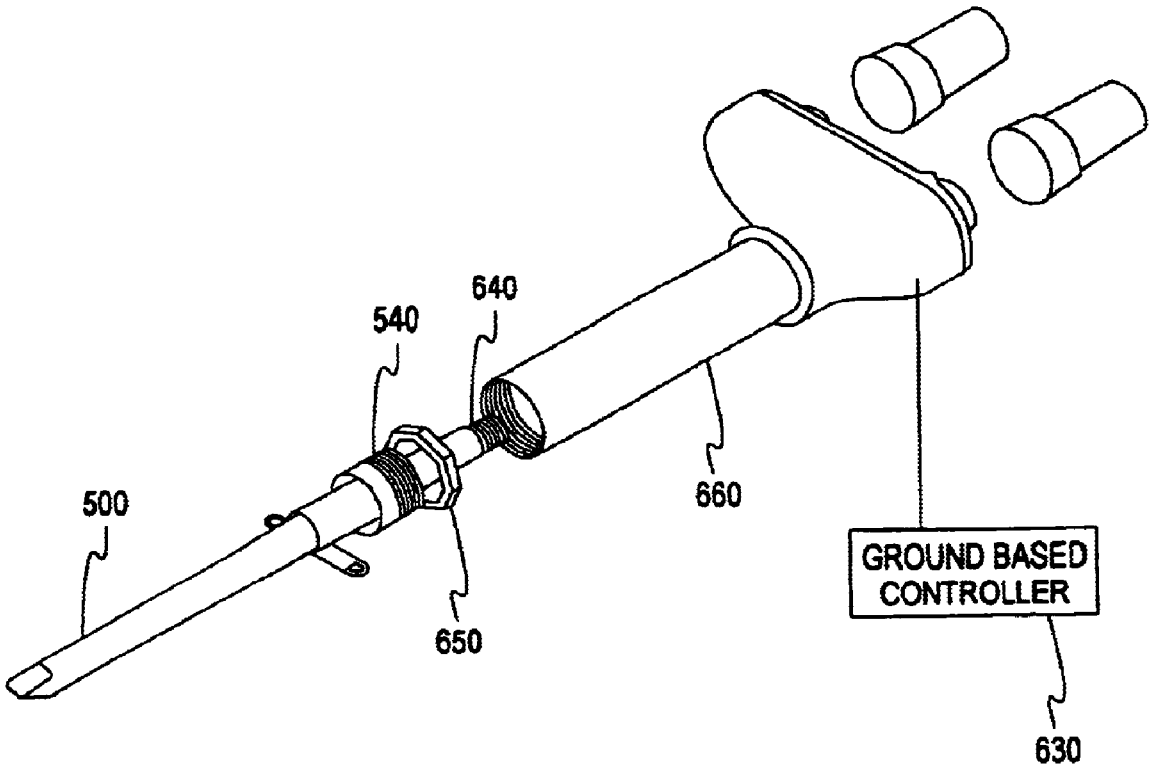
FIG. 8A is a perspective view of an actuator rod and an electrical actuator having a ground-based controller according to one embodiment of the present invention.
Figure 9:
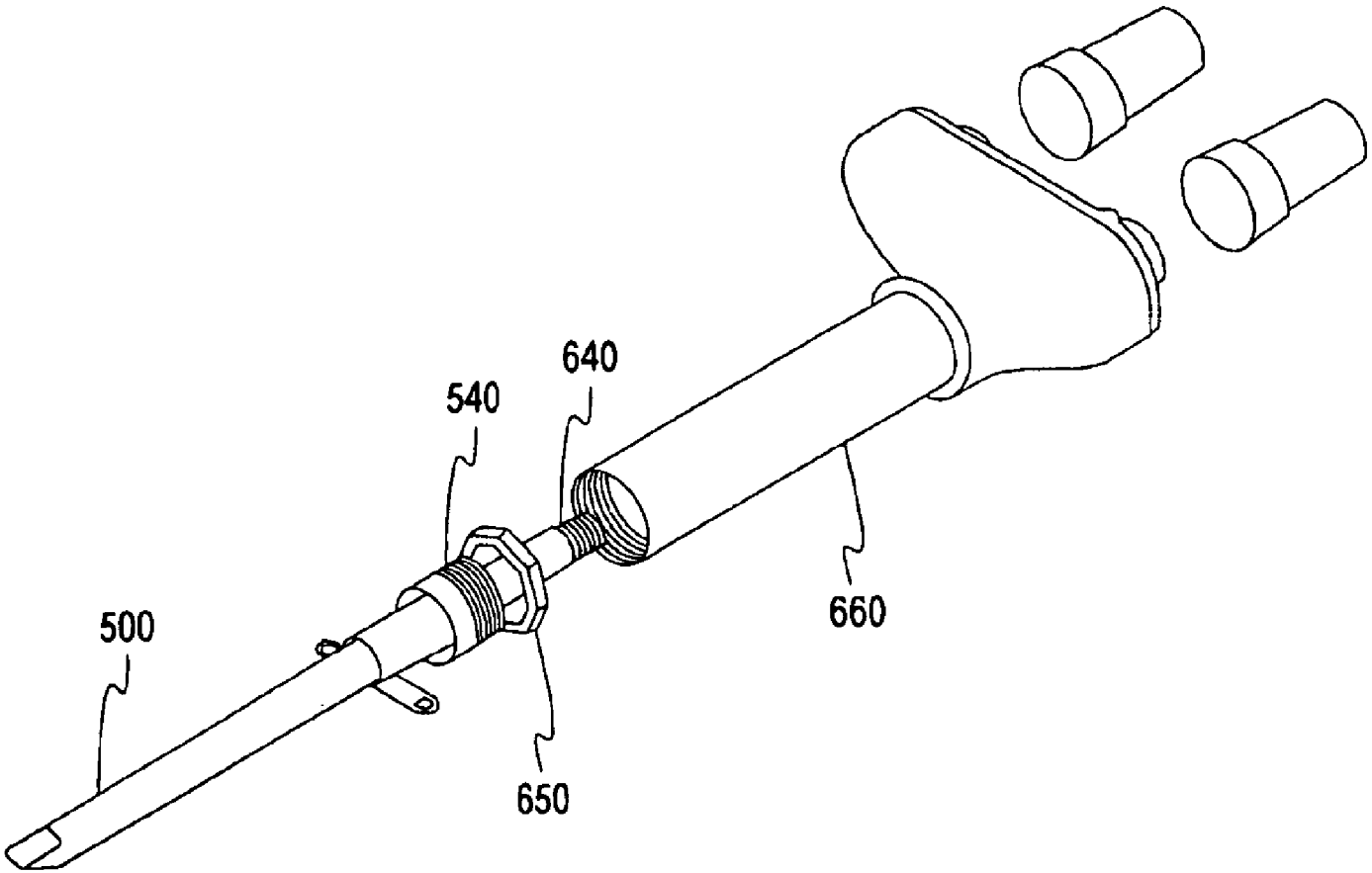
FIG. 9 is a perspective view of an actuator rod and an electrical actuator according to one embodiment of the present invention.

Although it is useful to have a manual actuator, it may be more desirable to have an electrical actuator that may be controlled from the ground or even remotely, for example, from a control room 630 (FIG. 8A). In FIG. 9, converting the manual actuator described above into an electrical actuator 660 is illustrated. The electrical actuator 660 comprises a piston (not shown) and a threaded barrel 670. To convert the manual actuator, the compression nut 595 and the knob 536 must first be removed. Then, a lock nut 650 is threaded onto the bushing mount 540. The threaded end 538 of the actuator rod 500 is threaded into the piston. The barrel 670 of the electrical actuator 660 is then pushed up towards the threaded portion 565 of the bushing mount 540 and threaded. Once both the piston and the threaded barrel are completely threaded onto the actuator rod 500, the lock nut 650 is tightened, locking the bushing mount 540 to the threaded barrel 670.

The electrical actuator 660 may be a step motor in a fixed position relative to the panel 160. The step motor rotates, driving a screw or shaft in a linear motion. The screw or shaft is coupled to the actuator rod 500 and, thus, moves the actuator rod 500 up and down, depending on the rotation of the step motor. It is also contemplated that the electrical actuator 660 may include a receiver 700 adapted to receive adjustment signals from a remote source 702. A sensor 704 adapted to sense the position of the actuator rod 500 may also be included. A transponder 706 may also be included to return a signal to the remote location or to a signal box which indicates the amount of adjustment made.

The present invention may, thus, be easily converted from a manual actuator to an electrical actuator depending on the needs and wishes of the user. The actuator, thus provides flexibility in use, allowing a user to purchase a manual actuator and then upgrade to an electrical actuator at a later date. The advantages to this are many. The user may not initially wish to expend the money to pay for an electrical actuator if there is rarely a need to adjust the vertical beam. As that need changes, however, the user may purchase the electrical actuator and easily convert the actuator.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A cellular base station antenna system, comprising:

a. an elongated panel antenna adapted to be mounted vertically and having a front side and a back side, said antenna producing a beam, said antenna comprising:

i. a feed system configured to supply signals to an arrangement of spaced first, second, third and fourth radiating elements on the front side of the panel antenna; and ii. an electromechanical phase adjustment system, comprising:

1. a first mechanical phase shifting component located on the back side of the panel antenna and in said feed system;

2. said first phase shifting component including a first stationary transmission line of arcuate configuration component coupled at opposed ends to the first and second radiating elements, and a signal-conducting moveable first wiper component configured to wipe across said first transmission line component and thereby shorten the signal path to one of said first and second coupled radiating elements while lengthening the signal path to the other of said coupled radiating elements;

3. a second mechanical phase shifting component located on the back side of the panel antenna and in said feed system;
4. said second phase shifting component including a second stationary transmission line component of arcuate configuration coupled at opposed ends to the third and fourth radiating elements, and a signal-conducting moveable second wiper component configured to wipe across said second transmission line component and thereby shorten the signal path to one of said third and fourth coupled radiating elements while lengthening the signal path to the other of said coupled radiating elements;
5. a motor supported by said panel antenna below said first and second phase shifting components at the bottom of the panel antenna;
6. a mechanical linkage coupling said motor to said first and second wiper components, said linkage including an elongated member between said motor at the bottom of the panel antenna and said first and second moveable wiper components and coupled to at least one pivotally mounted wiper arm supporting at least one of said first and second moveable wiper components such that activation of said motor causes said elongated member to move in a lengthwise direction along said panel antenna, causes said first and second wiper components to simultaneously wipe arcuately across said transmission line components, and causes the fixed elevation of the beam to change in relation to the direction and magnitude of the movement of said elongated member; and b. a beam elevation control system, comprising:
   i. a motor controller located remotely from said antenna and coupled to said motor;
   ii. said motor controller being configured to transmit beam elevation commands to said motor and to thereby make adjustments in beam elevation.

2. The antenna system defined by claim 1 wherein one of said first and second wiper components moves twice as far as the other of said wiper components when said elongated member is moved.

3. The antenna system defined by claim 1 further including a link interconnecting said first and second wiper components.

4. The antenna system defined by claim 1 wherein said mechanical linkage converts rotary movement of the motor to linear movement of the elongated member.

5. The antenna system defined by claim 1 wherein said beam elevation control system includes a beam position identifier to which said motor controller is responsive.

6. The antenna system defined by claim 1 wherein said elongated member has a terminus near a lower edge of said panel antenna.

7. The antenna system defined by claim 6 wherein said terminus of said elongated member is adapted first to facilitate manual manipulation of said elongated member to adjust beam elevation, and second to facilitate connection of said motor into said antenna system for remote electrical adjustment of beam elevation.

8. The antenna system defined by claim 6 wherein said terminus includes a threaded coupling nut through which said elongated member extends for connection to said motor.

9. The antenna system defined by claim 1 wherein said elongated member includes indicia providing an indication of beam elevation based upon the position of the elongated member.

10. The antenna system defined by claim 1 wherein said elongated member is composed of plastic.

11. The antenna system defined by claim 1 wherein said motor is adapted to be retrofitted to said panel antenna so as to hang below said panel antenna for easy installation.

12. The antenna system defined by claim 1 wherein said motor is configured to be retrofitted into said electromechanical phase adjustment system.

13. A cellular base station antenna system, comprising:

a. an elongated panel antenna adapted to be mounted vertically and having a front side and a back side, said antenna producing a beam, said antenna comprising:
   i. a feed system configured to supply signals to an arrangement of spaced first, second, third and fourth radiating elements on the front side of the panel antenna; and
   ii. an electromechanical phase adjustment system, comprising:
      1. a first mechanical phase shifting component located on the back side of the panel antenna and in said feed system;
      2. said first phase shifting component including a first stationary transmission line component of arcuate configuration coupled at opposed ends to the first and second radiating elements, and a signal-conducting moveable first wiper component configured to wipe across said first transmission line component and thereby shorten the signal path to one of said first and second coupled radiating elements while lengthening the signal path to the other of said coupled radiating elements;
      3. a second mechanical phase shifting component located on the back side of the panel antenna and in said feed system;
      4. said second phase shifting component including a second stationary transmission line component of arcuate configuration coupled at opposed ends to the third and fourth radiating elements, and a signal-conducting moveable second wiper component configured to wipe across said second transmission line component and thereby shorten the signal path to one of said third and fourth coupled radiating elements while lengthening the signal path to the other of said coupled radiating elements;
      5. a motor supported by said panel antenna below said first and second phase shifting components at the bottom of the panel antenna;
      6. a mechanical linkage coupling said motor to said first and second wiper components, said linkage including an elongated member between said motor at the bottom of the panel antenna and said first and second moveable wiper components and coupled to at least one pivotally mounted wiper arm supporting at least one of said first and second moveable wiper components such that activation of said motor causes said elongated member to move in a lengthwise direction along said panel antenna, causes said first and second wiper components to simultaneously wipe arcuately across said transmission line components, and causes the fixed elevation of the beam to change in relation to the direction and magnitude of the movement of said member; and b. a beam elevation control system, comprising:

i. a first controller coupled directly to said motor; and ii. a second controller coupled to said first controller from a location remote from said first controller;

iii. at least one of said controllers being configured to transmit beam elevation commands to said motor to cause the motor to make adjustments in fixed beam elevation.

14. The antenna system defined by claim 13 wherein said linkage is terminated below said panel antenna by a provision configured to enable said elongated member to be manually manipulated to adjust beam elevation if said motor is removed.

15. The antenna system defined by claim 14 wherein said provision includes a coupling nut for connecting said motor to said linkage.

16. The antenna system defined by claim 15 wherein said elongated member extends through said coupling nut for operative connection with drive means in said motor such that pulses sent to said motor from said first controller produce pulsed rotation of said motor causing step-wise linear movement of said elongated member and adjustment of the beam elevation.

17. The antenna system defined by claim 13 wherein one of said first and second wiper components moves twice as far as the other of said wiper components when said elongated member is moved.

18. The antenna system defined by claim 13 wherein said mechanical linkage converts between rotary movement of the motor and linear movement of the elongated member.

19. The antenna system defined by claim 13 wherein said beam elevation control system includes a beam position identifier to which said controller is responsive.

20. The antenna system defined by claim 13 wherein said elongated member has a terminus near a lower edge of said panel antenna.

21. The antenna system defined by claim 20 wherein said terminus of said elongated member is adapted first to facilitate manual manipulation of said elongated member to adjust beam elevation, and second to facilitate connection of said motor to said antenna system for remote electrical adjustment of beam elevation.

22. The antenna system defined by claim 20 wherein said terminus includes a threaded coupling nut through which said elongated member extends for connection to said motor.

23. The antenna system defined by claim 13 wherein said elongated member includes indicia providing an indication of beam elevation based upon the position of the elongated member.

24. The antenna system defined by claim 13 wherein said elongated member is composed of plastic.

25. The antenna system defined by claim 13 wherein said motor is adapted to be retrofitted to said panel antenna so as to hang below said panel antenna for easy installation.

26. The antenna system defined by claim 13 wherein said motor is configured to be retrofitted to said electromechanical phase adjustment system.

27. A cellular base station antenna system, comprising:

a. an elongated panel antenna adapted to be mounted vertically and having a front side and a back side, said antenna producing a beam, said antenna comprising:

i. a feed system configured to supply signals to an arrangement of spaced first and second radiating elements on the front side of the panel antenna; and ii. an electromechanical phase shifter including a stationary transmission line component of arcuate configuration coupled at opposed ends to the first and second radiating elements, and a signal-conducting moveable wiper component supported on a pivotally mounted wiper arm configured to wipe said wiper component arcuately across said stationary transmission line component and thereby shorten the signal path to one of said first and second coupled radiating elements while lengthening the signal path to the other of said coupled radiating elements;

a mechanical linkage including an elongated member extending lengthwise along a portion of said panel antenna from a terminus located near a bottom edge of said panel antenna to said pivotally mounted wiper arm, said wiper arm converting linear movement of said elongated member to arcuate movement of said moveable wiper component; and wherein said terminus is structured first to facilitate manual linear manipulation of said elongated member to adjust beam elevation and second to facilitate connection to a remotely controllable electric motor.

28. The antenna system defined by claim 27 wherein said linkage is terminated below said panel antenna by a provision configured to permit said elongated member to be manually manipulated to adjust beam elevation.

29. The antenna system defined by claim 28 wherein said provision includes a coupling nut for connecting a motor to said linkage.

30. The antenna system defined by claim 29 wherein said elongated member extends through said coupling nut for operative connection with drive means in a motor such that pulses sent to said motor from a controller produce pulsed rotation of said motor causing step-wise linear movement of said elongated member and adjustment of the beam elevation.

31. The antenna system defined by claim 27 wherein said elongated member includes indicia providing an indication of beam elevation based upon the position of the elongated member.

32. The antenna system defined by claim 27 wherein said elongated member is composed of plastic.

33. For use with a cellular base station antenna adapted to mount a plurality of radiating elements, a signal phase adjuster coupled to said radiating elements, and a linearly reciprocable, phase-adjustment mechanical linkage coupled to said phase adjuster and having a terminating provision located beyond an edge of said antenna, an article of manufacture comprising an electric actuator configured to connect to said provision to permit said phase adjuster to be manipulated under control of a remotely located controller.

* * * * *